US011920334B1

(12) United States Patent
Archibald

(10) Patent No.: US 11,920,334 B1
(45) Date of Patent: Mar. 5, 2024

(54) URINE SPLASH GUARD FOR THE REAR OF A TOILET SEAT

(71) Applicant: Darius Archibald, Philadelphia, PA (US)

(72) Inventor: Darius Archibald, Philadelphia, PA (US)

( * ) Notice: Subject to any disclaimer, the term of this patent is extended or adjusted under 35 U.S.C. 154(b) by 0 days.

(21) Appl. No.: 17/947,379

(22) Filed: Sep. 19, 2022

(51) Int. Cl.
*E03D 9/00* (2006.01)

(52) U.S. Cl.
CPC ..... *E03D 9/00* (2013.01)

(58) Field of Classification Search
CPC ..... A47K 13/24; E03D 9/00
USPC ..... D23/296, 310; 4/661
See application file for complete search history.

(56) References Cited

U.S. PATENT DOCUMENTS

| | | | | |
|---|---|---|---|---|
| 6,385,785 | B1 | 5/2002 | Linden | |
| 8,719,972 | B1 * | 5/2014 | Baker | A47K 17/00 4/300.3 |
| 9,551,139 | B2 * | 1/2017 | Todd, IV | A47K 13/24 |
| 9,822,518 | B1 | 11/2017 | Arriaga | |
| 2013/0000027 | A1 * | 1/2013 | San Luis | E03D 9/00 4/300.3 |
| 2021/0274986 | A1 * | 9/2021 | Braun | A47K 13/24 |
| 2022/0325513 | A1 * | 10/2022 | Griffith | A47K 13/24 |

* cited by examiner

*Primary Examiner* — Christine J Skubinna
(74) *Attorney, Agent, or Firm* — Sanchelima & Associates, P.A.; Christian Sanchelima; Jesus Sanchelima

(57) ABSTRACT

A urine splash guard for the rear of a toilet including a protecting assembly and a removing assembly. The protecting assembly includes an absorbing pad. The absorbing pad is made of and absorbent and flushable material. The absorbing pad is fixed between a rear portion of a toilet seat and the bowl rim of the toilet to prevent splashing urine therein. The absorbing pad is fixed through an adhesive element located in a bottom face of the absorbing pad. The removing assembly includes an opening, the opening goes through the said absorbing pad, the opening is used to hold the absorbing pad.

7 Claims, 2 Drawing Sheets

URINE SPLASH GUARD FOR THE REAR OF A TOILET SEAT

II. BACKGROUND OF THE INVENTION

1. Field of the Invention

The present invention relates to a urine splash guard for the rear of a toilet seat and, more particularly, to a urine splash guard for the rear of a toilet seat that prevents the rear portion of the toilet seat to get wet.

2. Description of the Related Art

Several designs for splash guards have been designed in the past. None of them, however, include a removing element to remove the splash guard without touching it.

Applicant believes that a related reference corresponds to U.S. Pat. No. 6,385,785 issued for a removable urine blocking shield which mounts the back of a toilet seat. Applicant believes that another related reference corresponds to U.S. Pat. No. 9,822,518 issued for a toilet bowl mounted urine splash preventing device. None of these references, however, teach of a urine splash guard and shield apparatus mounted to the rear portion of a toilet seat located between the toilet seat and the toilet bowl rim wherein the shield prevents urine from splashing onto the seat or from splashing into the gap between the seat and rim.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a urine splash guard for the rear of a toilet seat that includes an adhesive element to adhere the splash guard to the rear portion of a toilet.

It is another object of this invention to provide a urine splash guard for the rear of a toilet seat that includes a waterproof shield which can prevent splash of urine in the rear portion of the toilet seat.

It is still another object of the present invention to provide a urine splash guard for the rear of a toilet seat that includes a splash guard made of a flushable material.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
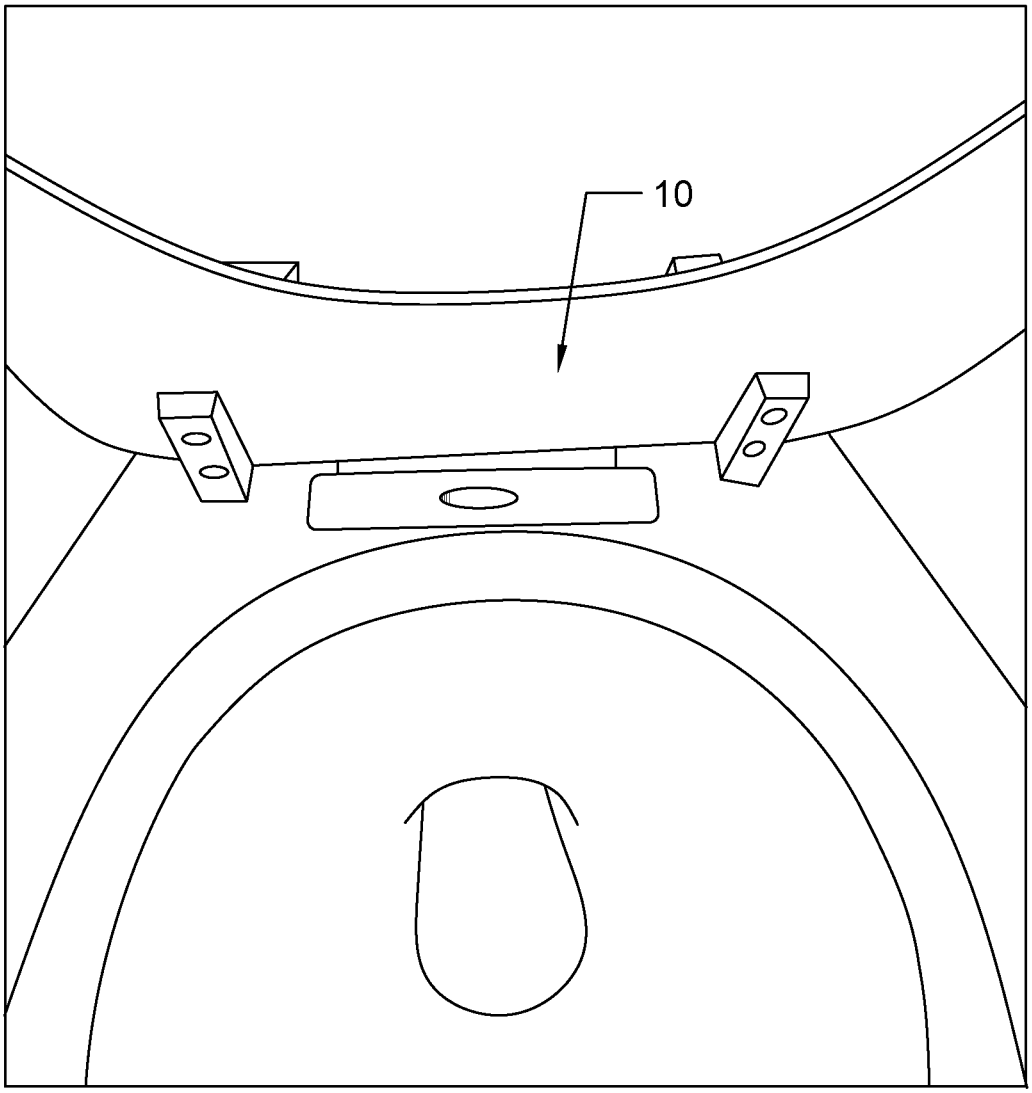

With the above and other related objects in view, the invention consists in the details of construction and combination of parts as will be more fully understood from the following description, when read in conjunction with the accompanying drawings in which:

FIG. 1 represents an isometric operational view of the present invention 10 placed over a rear portion of the toilet bowl rim.

Figure 2:
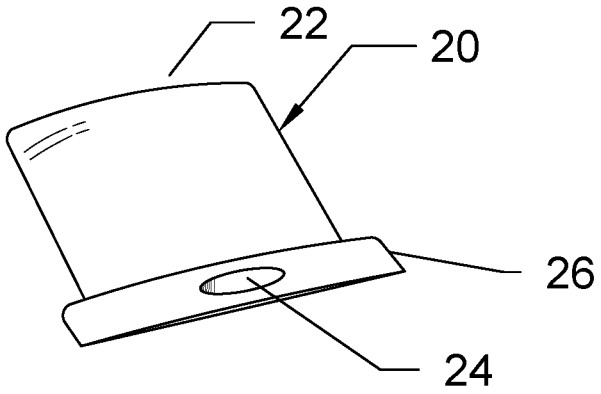

FIG. 2 shows an isometric view of the present invention 10. The present invention 10 includes a protecting assembly 20 and a removing assembly 40.

Figure 3:
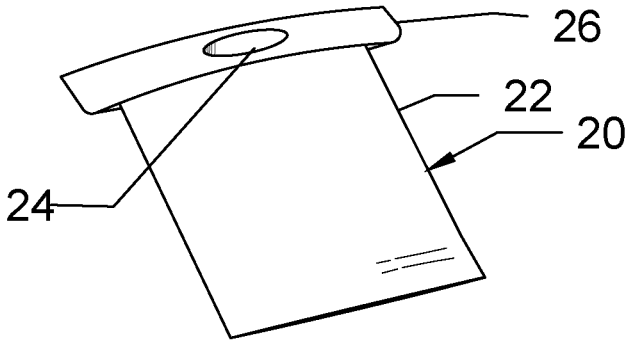

FIG. 3 is a representation of a rear view of the present invention 10.

V. DETAILED DESCRIPTION OF THE EMBODIMENTS OF THE INVENTION

Referring now to the drawings, where the present invention is generally referred to with numeral 10, it can be observed that it basically includes a protecting assembly 20 and a removing assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The protecting assembly 20 may include an absorbing pad 22, a front portion 24 and an adhesive element 26. As best illustrated in FIG. 1 the protecting assembly may be placed in a rear portion of a toilet seat between the toilet seat and the toilet bowl. The absorbing pad 22 may have a rectangular shape. It also may be suitable for the absorbing pad 22 to have a triangular shape, a circular shape, or any other suitable shape. The absorbing pad 22 may be flushable. The absorbing pad 22 may be liquid-absorbent. The absorbing pad 22 may be made of cotton, paper, or any other suitable material. The absorbing pad 22 may have a great ratio of the Absorbency Under Load. In a preferred embodiment the absorbing pad 22 may have a ratio of Absorbency Under Load to the Centrifuge Retention Capacity of about 0.6 or greater. It may be suitable for the absorbing pad 22 to have such thickness that allows the absorbing pad to be splashed multiple times without tearing apart. It may be suitable for the absorbing pad 22 to include fragrance.

The front portion 24 may have a rectangular shape. It also may be suitable for the front portion 24 to have a circular shape, a triangular shape, or any other suitable shape. In a preferred embodiment the front portion 24 may fully cover the rear portion of a toilet seat. The front portion 24 may be attached to a front of the absorbing pad 22. Thus, the front portion 24 may be made of an absorbent and flushable material. The absorbing pad 22 may be located behind the lid of the toilet. It may be suitable for the absorbing pad 22 and the front portion 24 to have such thickness that allows the absorbing pad to be splashed multiple time without tearing apart. It may be suitable for the front portion 24 to include fragrance.

The absorbing pad 22 may have a top face. The top face of the absorbing pad 22 may be absorbent. The absorbing pad 22 may have a bottom face. The bottom face of the absorbing pad 22 may include an adhesive element 26. The adhesive element 26 may conform with the shape of the bottom face of the absorbing pad 22. The bottom face of the absorbing pad 22 may be a mirror image of the top face of the absorbing pad 22. The adhesive element 26 may be epoxy adhesives, cyanoacrylates adhesives, water-based adhesives, anaerobic adhesives, dextrin adhesives, or an y other adhesives known in the prior art. The adhesive element 26 may preferably be a not-pulling to water adhesive.

The absorbing pad 22 may have the removing assembly 40 therein. The removing assembly 40 may include an opening 42. The opening 42 may transversally go through the front portion 44. It also may be suitable for the opening 42 to transversally go through any other portion of the absorbing pad 22. The opening 42 may have inner walls. It may be suitable for the inner walls of the opening 42 to be reinforced. The opening 42 may be used to introduce any element thereinto to remove the absorbing pad 22 without touching it with the hands.

In a preferred embodiment a user may place the absorbing pad 22 between the toilet seat and the toilet bowl rim of a toilet. The absorbing pad 22 may be fixed to the toilet seat and the toilet bow through the adhesive element 26. The absorbing pad 22 may prevent urine from splashing onto the seat or the gap between the seat and rim. After a predetermined number of days, the present invention 10 may be removed through inserting any suitable element into the opening 42 and pulling the absorbing pad 22 to the toilet. The present invention 10 is flushable.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A urine splash guard for the rear of a toilet seat, comprising:

a protecting assembly, wherein said protecting assembly includes an absorbing pad, said absorbing pad is made of an absorbent material, said absorbing pad is configured to be placed between a rear portion of a toilet seat and the bowl rim of said toilet to prevent splashing urine therein, wherein said absorbing pad includes fragrance, wherein said absorbing pad includes a front portion and a rear portion, wherein said front portion of said absorbing pad has a greater length than a length of said rear portion, wherein said rear portion has a rectangular shape and said front portion has a rectangular elongated shape, wherein said front portion has a width smaller than a width of said rear portion wherein said absorbing pad has a ratio of absorbency under load to the centrifuge retention capacity above 0.6; and a removing assembly, wherein said removing assembly includes an opening, said opening goes through a central portion of said front portion, said opening is used to hold said absorbing pad.

2. The urine splash guard for the rear of a toilet seat set forth in claim 1, wherein said rear portion of said absorbing pad is placed behind and beneath a lid of said toilet.

3. The urine splash guard for the rear of a toilet seat set forth in claim 1, wherein said absorbing pad has a top face and a bottom face, said bottom face is absorbent.

4. The urine splash guard for the rear of a toilet seat set forth in claim 1, wherein said bottom face includes an adhesive element.

5. The urine splash guard for the rear of a toilet seat set forth in claim 4, wherein said adhesive element adheres said absorbing pad between said rear portion of said toilet seat and said bowl rim of said toilet.

6. The urine splash guard for the rear of a toilet seat set forth in claim 1, wherein said absorbing pad is capable of be flushable into the toilet.

7. A urine splash guard for the rear of a toilet seat, consisting of:

a protecting assembly, wherein said protecting assembly includes an absorbing pad, said absorbing pad is made of an absorbent material, said absorbing pad is flushable in the toilet, said absorbing pad includes fragrance, said absorbing pad is placed between a rear portion of a toilet seat and the bowl rim of said toilet to prevent splashing urine therein, said absorbing pad has a top face and a bottom face, said bottom face is absorbent, said bottom face includes an adhesive element, said adhesive element adheres said absorbing pad between said rear portion of said toilet seat and said bowl rim of said toilet, said rear portion of said absorbing pad is placed behind and beneath the lid of said toilet, wherein said front portion of said absorbing pad has a greater length than a length of said rear portion, wherein said rear portion has a rectangular shape and said front portion has a rectangular elongated shape, wherein said front portion has a width smaller than a width of said rear portion wherein said absorbing pad has a ratio of absorbency under load to the centrifuge retention capacity above 0.6; and a removing assembly, wherein said removing assembly includes an opening, said opening goes through a central portion of said front portion, said opening is used to hold said absorbing pad.

* * * * *